United States Patent [19]

Sawyer

[11] Patent Number: 4,494,439

[45] Date of Patent: Jan. 22, 1985

[54] FIRING MECHANISM FOR HIGH RATE OF FIRE REVOLVING BATTERY GUN

[75] Inventor: Quentan T. Sawyer, Milton, Vt.

[73] Assignee: General Electric Company, Burlington, Vt.

[21] Appl. No.: 488,226

[22] Filed: Apr. 25, 1983

[51] Int. Cl.[3] ..... F41D 7/04

[52] U.S. Cl. ..... 89/12; 89/33.04

[58] Field of Search ..... 89/12, 13 R, 172, 185, 89/33 SF

[56] References Cited

U.S. PATENT DOCUMENTS

| | | | |
|---|---|---|---|
| 3,380,341 | 4/1968 | Chiabrandy | 89/12 |
| 4,274,325 | 6/1981 | Snyder et al. | 89/12 |
| 4,301,710 | 11/1981 | Kirkpatrick | 89/12 |
| 4,345,505 | 8/1982 | Patenaude et al. | 89/12 X |
| 4,359,927 | 11/1982 | Tassie | 89/12 |
| 4,359,928 | 11/1982 | Sawyer | 89/12 |

OTHER PUBLICATIONS

General Electric Report, No. 82APB 518, Mar. 1982, pp. i and 40–47.

*Primary Examiner*—David H. Brown

*Attorney, Agent, or Firm*—Bailin L. Kuch

[57] ABSTRACT

This invention provides a Gatling type gun having a housing; a rotor journaled for rotation with respect to said housing; said rotor having a plurality of gun bolts disposed in an annular row with respective firing pin assemblies which do not include a firing pin spring; switchable firing pin assembly control means mounted to said housing for sequentially engaging each of said firing pin assemblies during rotation of said rotor and having a first disposition for positively projecting the forward tip of each firing pin forward of the face of its respective gun bolt by coupling the kinetic energy of the rotor to the firing pin over a period of time, and a second disposition for positively precluding the forward tip of each firing pin from projecting forward of the face of its respective gun bolt, and switching means coupled to said control means for remotely switching said control means to and between said first and second dispositions.

7 Claims, 8 Drawing Figures

FIRE

SAFE

FIRING MECHANISM FOR HIGH RATE OF FIRE REVOLVING BATTERY GUN

BACKGROUND OF INVENTION

1. Field of the Invention

This invention relates to a firing mechanism for the gun bolts of a Gatling type gun.

2. Prior Art

The conventional modern Gatling type gun includes a plurality of gun bolts, each having a firing pin which is energized by a spring which is compressed and then released. In guns of the type shown in U.S. Pat. No. 3,380,341, issued to R. E. Chiabrandy on Apr. 30, 1968, a single main spring sequentially operates each of a plurality of firing pins on respective gun bolts. When the gun is safed, the tip of the firing pin is still able to project forward of the face of the gun bolt. In guns of the type shown in U.S. Pat. No. 4,301,710, issued to R. G. Kirkpatricck on Nov. 24, 1981, each gun bolt has a respective firing pin and spring. Each spring is sequentially compressed and then released to project the tip of the pin forward of the bolt face. Each spring is compressed by a cocking pin riding on a ramp cam surface and then released by the cocking pin passing off the surface, as is shown in U.S. Pat. No. 4,359,927, issued to D. P. Tassie on Nov. 23, 1982; U.S. Pat. No. 4,359,928 issued to Q. T. Sawyer on Nov. 23, 1982; and U.S. Pat. No. 4,274,325 issued to R. R. Snyder et al on June 23, 1981. In each case, to safe the gun, a continuum for the ramp cam surface is provided. If the continuum is not effectively provided, the pin may be free to project forward of the bolt face.

SUMMARY OF THE INVENTION

It is an object of this invention to provide a firing mechanism for the gun bolt of a Gatling type gun wherein when the rotor carrying the gun bolts is not rotating, no energy is available to he firing pin.

Another object is to provide a firing mechanism which does not require the compression and the relese of a spring to project the firing pin forward of the face of the gun bolt to thereby fire the round of ammunition.

Yet another object is to provide a gun bolt that does not require a firing pin spring.

A feature of this invention is the provision of a Gatling type gun having a housing; a rotor journaled for rotation with respect to said housing; said rotor having a plurality of gun bolts disposed in an annular row with respective firing pin assemblies which do not include a firing pin spring; and switchable firing pin assembly control means mounted to said housing for sequentially engaging each of said firing pin assemblies during rotation of said rotor and having a first disposition for positively projecting the forward tip of each firing pin forward of the face of its respective gun bolt by coupling the kinetic energy of the rotor to the firing pin over a period of time, and a second disposition for positively precluding the forward tip of each firing pin from projecting forward of the face of its respective gun bolt.

DESCRIPTION OF THE DRAWING

These and other objects, features and advantages of the invention will be apparent from the following specifications thereof taken in conjunction with the accompanying drawing in which.

DESCRIPTION OF THE PREFERRED EMBODIMENT

Figure 3:
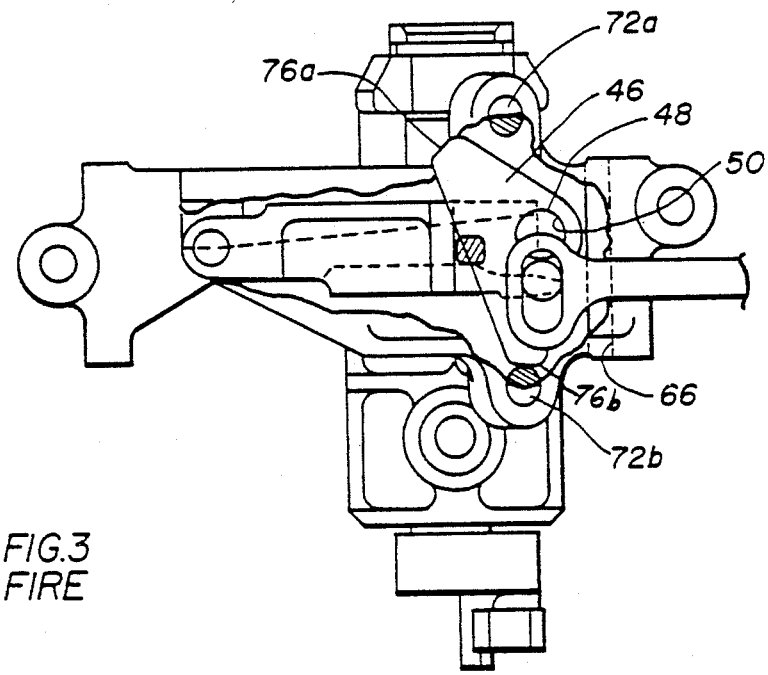
FIG. 3 is a top view of a detail of FIG. 1.
Figure 2:
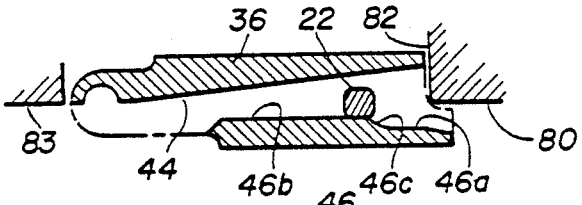
FIG. 2 is a section taken along the curved surface II—II of FIG. 1.
Figure 1:
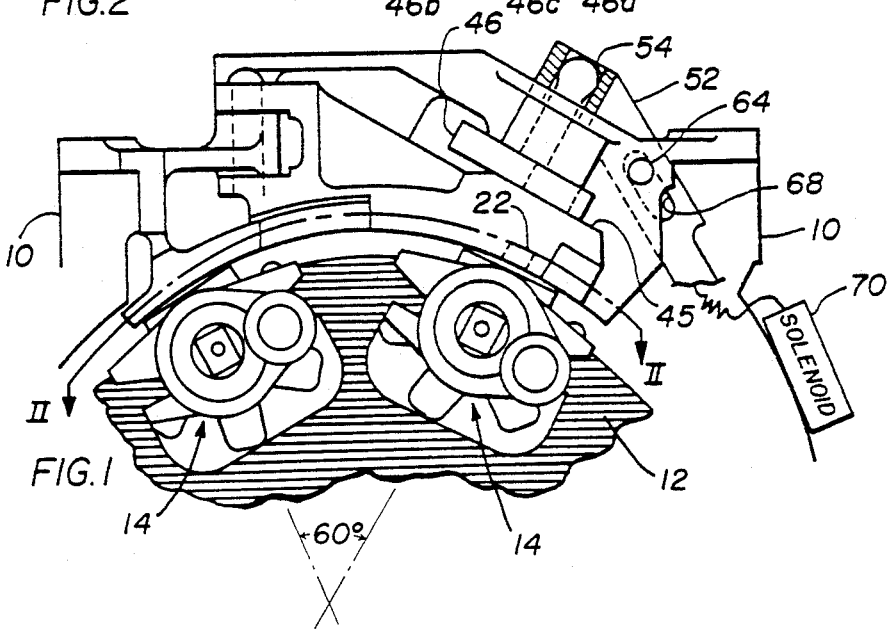
FIG. 1 is a partial transverse view, looking from aft forwardly, through a Gatling type gun having a firing mechanism embodying this invention and showing the cam-gate element in its fire disposition.

The Gatling type gun includes a stationary housing 10 in which is journaled a rotor 12 having a plurality of gun bolts 14 which slide on tracks 16 fixed to the rotor. Each gun bolt has a roller 18 which rides in a helical cam track in the housing, so that as the rotor 12 turns, each bolt 14 is traversed fore and aft along its tracks. Each bolt also has a firing pin 20 and a cocking pin 22 standing up through a slot in the bolt body 24 and a slot in the bolt carriage 26.

The firing/safing mechanism 28 includes a main frame 32 which has a knuckle 34 to which a gate element 36 is hinged by a pin 38 passing through respective bores in its clevis 40 and the knuckle. The gate element 36 has a transversely and upwardly extending blind slot 42 therein bounded by a forward face 44 and an aft face **46*a* and 46*b*. The surface 46*a* is more aft than the surface 46*b*, with a sharp ramp surface 46*c* therebetween. The distal end of each cocking pin 22 passes into, through, and out of the slot 42 as the respective gun bolt is carried by the rotor 12** past its fire angular position.

The gate element 36 has a flat surface 45 on which an actuator plate 46 lies. The actuator plate is journaled to pivot on the surface 45 by a post 48 standing up from and fixed to the gate element and riding in a bore 50 through the plate. A linkage 52 has a pocket 54 at one end thereof which receives the distal end of a post 56 which is fixed to and stands up from the actuator plate 46. This post passes up through an aperture 58 in an aftwardly projecting upper portion 60 of the main frame 32 and which upper portion overlies the actuator plate 46. The linkage is guided through a slot 62 in the main frame 32 and is captured to the main frame by pin 64 passing through a bore 66 in the main frame and a slot 68 in the linkage. The other end of the linkage is connected against a spring bias return to the armature of a solenoid 70 which is fixed to the housing 10. A post **72*a* is fixed to and stands up from the main frame 32. The aftward facing peripheral surface 74*a* of this post serves as a caming surface with respect to a cam following surface 76*a* provided by the forward facing peripheral surface of the actuator plate 46. A similar post 72*b* is fixed to and stands up from the main frame 32. The forward facing peripheral surface 74*b* of this post serves as a caming surface with respect to a cam following surface 76*b* provided by the forward facing peripheral surface of the actuator plate 46**.

As shown in FIG. 3, the fire disposition, the linkage 52 is pulled to the right by the solenoid 70 against the spring bias return which is internal to the solenoid and the actuator plate is swung about the pivot post 48 into its counter-clockwise dispositon, with the cam follower surface 76a spaced away from the cam post surface 74a and the cam follower surface 76b riding against the cam post surface 74b. The gate element 36 is swung about its pivot pin 38 into its counter-clockwise disposition, by its pivotal connection to the actuator plate which is the pivot post 48. The distal end of the gate element is in its forward-most disposition with its forward inner wall 44 spaced forwardly away from the path of travel of the cocking pin 22 of the gun. The surface 80 on the main frame, which is similar to the conventional cocking ramp cam as shown in U.S. Pat. No. 4,274,325, is spaced forward of the gate element aft surface 46a by a gap just large enough to pass the cocking pin 22. The sear corner 82 of the surface 80 is to the right of the aft ramp surface 46c. The surface serves to hold the cocking pin aft and, thereby, the firing pin aft, until the cocking pin passes the sear corner 82. The cocking pin has been riding on, or closely adjacent to, the aft surface 46a and is then free to be accelerated quickly forward by the ramp surface 46c, with the forward tip of the firing pin concomitantly being accelerated forward of the face of the gun bolt. The ramp surface 46c serves to couple the rotor 12 to the firing pin via the cocking pin, over the period of time determined by the angle subtended by the transverse sector of the ramp surface and the rotational velocity of the rotor. Throughout that period of time, kinetic energy from the rotor is transmitted to the forwardly moving firing pin and is available to the primer of a round of ammunition. The cocking pin then rides on, or adjacent, the aft surface 46b until the cocking pin abuts the forward surface 44 of the gate element, which surface cams the cocking pin aft, and thereby, the firing pin aft, so that the cocking pin may then ride onto another conventional cam surface 83 of the main frame which is similar to the surface shown in U.S. Pat. No. 4,274,325.

Figure 8:
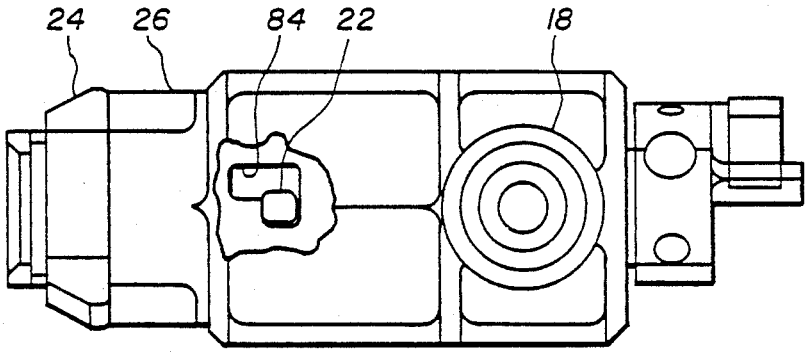
FIG. 8 is a top view of the gun bolt of FIG. 7.

The firing pin is additionally secured in its aft disposition in the gun bolt by the conventional L-slot 84 in the gun bolt body as shown in U.S. Pat. No. 3,595,128 issued to J. P. Hoyt, Jr. on July 27, 1971, and U.S. Pat. No. 3,611,871 issued to R. G. Kirkpatrick et al on Oct. 12, 1971. The gun bolt is shown in FIG. 8 in its unlocked disposition with the toe of the L-slot holding the cocking pin aft. When the gun bolt body 24 is rotated with respect to the gun bolt carriage 26 and the cocking pin into its locked disposition, the leg of the L-slot is aligned with the cocking pin and the cocking pin would, but for the cam surface sear corner 82, be free to move forward. The cocking pin clears the corner of the L-slot of the bolt carriage just before it clears the sear corner of the main frame.

Figure 6:
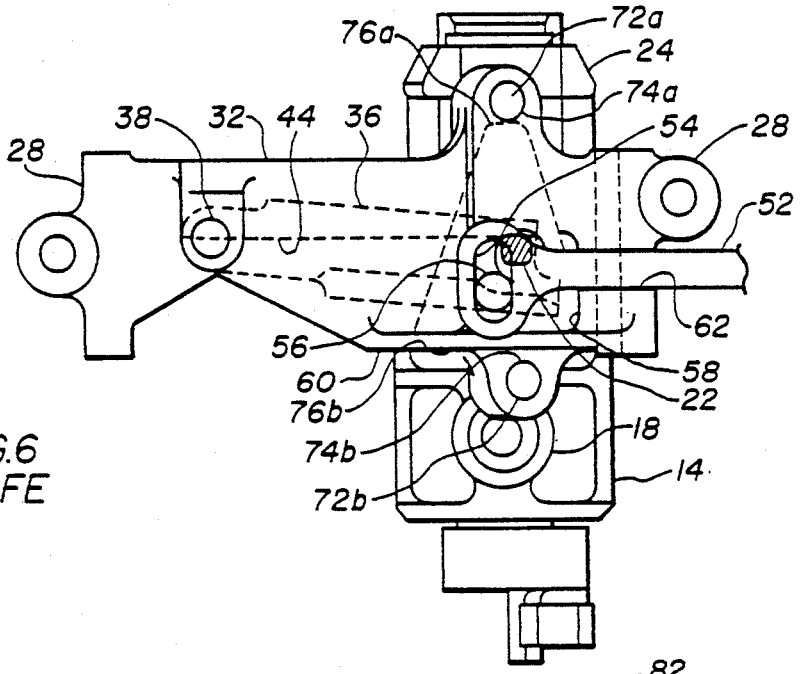
FIG. 6 is a top view of a detail of FIG. 4.
Figure 5:
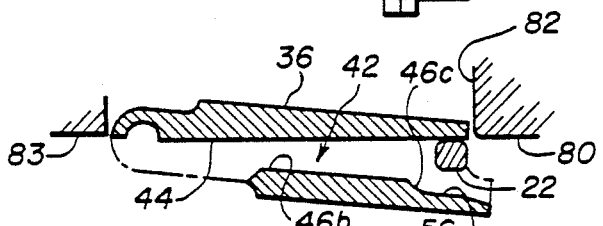
FIG. 5 is a section taken along the curved surface V—V of FIG. 3.
Figure 4:
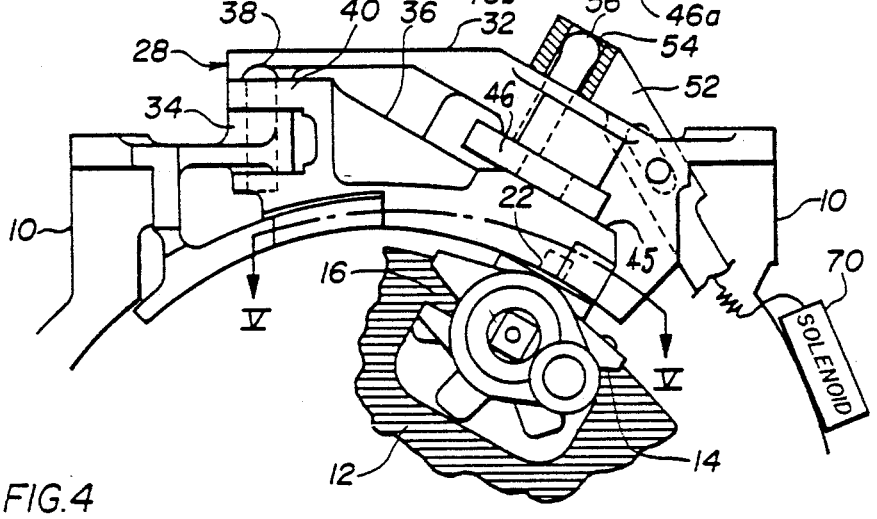
FIG. 4 is a view similar to FIG. 1, showing the cam-gate element in its safe disposition.
Figure 7:
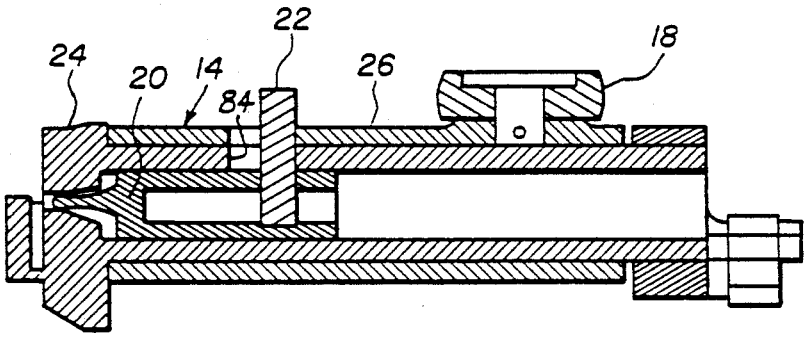
FIG. 7 is a longitudinal view in cross-section of the gun bolt with it firing pin and cocking lever which interacts with the cam-gate element.

As shown in FIG. 6, the safe disposition, the linkage is pushed to the left by the spring return bias of the solenoid 70 and the actuator plate is swung about the pivot post into its clockwise disposition, with the cam follower surface 76a riding against the cam post surface 74b and the cam follower surface 76b spaced away from the cam post surface 74a. The gate element 36 is swung about its pivot pin 38 into its clockwise disposition, by its pivotal connection 48 to the actuator plate. The distal end of the gate element is in its aftward most disposition with its forward inner wall 44 aligned with the surface 80. The cocking pin is spaced away from the aft wall 46a, 46b, 46c, and rides on the wall 44 thence onto the surface 83. Thus, at no time is the cocking pin cleared to move forward, and thereby the forward tip of the firing pin is precluded from moving forward of the face of the gun bolt. This preclusion occurs nothwithstanding the gun bolt body may have rotated into its locked disposition and the cocking pin is aligned with the leg of the L-slot 84.

The solenoid may be energized if, and only if, the trigger is actuated. Upon trigger release, and even before cessation of rotation of the rotor, the spring return bias will swing the gate to its sfe disposition and provide cease-fire. In a gun having automatic reverse clearing, the gun will be swung to its safe disposition before the onset of reverse rotation of the rotor. This use of a control signal as a trigger function permits the gun to be armed or safed remotely, thereby providing significant safety of operating personnel. As stated, it can be safed during a firing burst, thereby minimizing the cease fire function time. Even if a gun bolt is at rest at the angular firing disposition, since there is no spring on the firing pin to oppose the spring bias return of the solenoid, the spring bias return will be effective to swing the gate element and the thereagainst abutting cocking pin to the safe disposition.

I claim:

1. A Gatling type gun comprising:

a housing;

a rotor journaled for rotation with respect to said housing;

a plurality of gun bolts disposed in an annular row on said rotor;

each gun bolt having a respective face, a firing pin, and a cocking pin fixed to said firing pin;

switchable firing pin control means mounted to said housing for sequentially engaging each of said cocking pins during rotation of said rotor of the respective gun bolts past the firing angular sector of said gun, and having a first disposition for positively projecting the forward tip of each firing pin, whose respective cocking pin has been engaged, forward of said face of its respective gun bolt, by coupling the kinetic energy of the rotor to the firing pin over a period of time, and a second disposition for positively precluding the forward tip of each firing pin from projecting forward of said face of its respective gun bolt; and switching means coupled to said switchable firing pin control means for remotely switching said control means to and between said first and second dispostions.

2. a Gatling type gun according to claim 1 having a reverse clearing mode of operation wherein:

said rotor is journaled for rotation in a first direction with respect to said firing pin control means for firing, and said rotor is journaled for rotation in a second direction, opposite to said first direction, for clearing.

3. A Gatling type gun according to claim 1, wherein:

said switchable firing pin control means includes a cam surfave effective in said first disposition for abutting a passing thereby cocking pin and caming it forward as its respective gun bolt is carried by said rotor past the firing angular sector of said gun.

4. A Gatling type gun according claim 3, wherein:

said switchable firing pin control means includes an additional cam surface effective in said second disposition for abutting a passing thereby cocking pin and precluding any forward movement thereof as its respective gun bolt is carried by said rotor past the firing angular sector of said gun.

5. A Gatling type gun according to claim 4, further including a switchable linkage assembly coupled to said switchable firing pin control means and to a solenoid having a spring return bias and having a first disposition when said solenoid is energized serving to move to and hold said firing pin control means in its said first disposition, and a second disposition when said solenoid is not energized serving to move to and lock said firing pin control means in its said second disposition.

6. A Gatling type gun comprising:

a housing;

a rotor journaled for rotation with respect to said housing;

a plurality of gun bolts disposied in an annular row on said rotor;

each gun bolt having a respective face, a firing pin, and a cocking pin fixed to said firing pin;

switchable firing pin control means mounted to said housing for sequentially engaging each of said cocking pins during rotation of said rotor of the respective gun bolts past the firing angular sector of said gun, and having a first disposition for positively projecting the forward tip of each firing pin, whose respective cocking pin has been engaged, forward of said face of its respective gun bolt, by coupling the kinetic energy of the rotor to the firing pin over a period of time, a second disposition for positively precluding the forward tip of each firing pin from projecting forward of said face of its respective gun bolt;

said switchable firing pin control means including a cam surface effective in said first disposition for abutting a passing thereby cocking pin and caming it forward as its respective gun bolt is carried by said rotor past the firing angular sector of said gun;

said switchable firing pin control means also including an additional cam surface effective in said second disposition for abutting a passing thereby cocking pin and pecluding any forward movement thereof as its respective gun bolt is carried by said rotor past the firing angular sector of said gun; and a switchable linkage assembly coupled to said switchable firing pin control means and to a solenoid having a spring return bias and having a first disposition when said solenoid is energized serving to move and hold said firing pin control means in its said first disposition, and a second disposition when said solenoid is not energized serving to move to and lock said firing pin control means in its said second disposition.

7. A Gatling type gun according to claim 6 having a reverse clearing mode of operation wherein:

said rotor is journaled for rotation in a first direction with respect to said firing pin control means for firing, and said rotor is journaled for rotation in a second direction, opposite to said first direction, for clearing.

* * * * *